United States Patent [19]

Ito et al.

[11] Patent Number: 4,752,802

[45] Date of Patent: Jun. 21, 1988

[54] MAGNETIC BRUSH TYPE DEVELOPING APPARATUS FOR DEVELOPMENT OF ELECTROSTATIC LATENT IMAGE

[75] Inventors: Kouji Ito; Susumu Sakakibara, both of Toyokawa; Hideya Nishise, Toyohashi, all of Japan

[73] Assignee: Minolta Camera Kabushiki Kaisha, Osaka, Japan

[21] Appl. No.: 59,850

[22] Filed: Jun. 9, 1987

[30] Foreign Application Priority Data

Jun. 10, 1986 [JP] Japan ..... 61-135411

[51] Int. Cl.[4] ..... G03G 15/08

[52] U.S. Cl. ..... 355/3 DD; 355/14 D; 118/657; 430/122

[58] Field of Search ..... 355/3 DD, 14 D; 118/657; 430/122

[56] References Cited

U.S. PATENT DOCUMENTS

| | | | |
|---|---|---|---|
| 3,572,288 | 3/1971 | Turner | 118/657 |
| 4,492,456 | 1/1985 | Haneda et al. | 355/3 DD |
| 4,585,326 | 4/1986 | Okamoto et al. | 355/3 DD |
| 4,591,261 | 5/1986 | Saruwatari et al. | 355/3 DD X |
| 4,592,653 | 6/1986 | Ikeda et al. | 355/3 DD |

FOREIGN PATENT DOCUMENTS 59-2057 1/1984 Japan .

*Primary Examiner*—A. C. Prescott

[57] ABSTRACT

At least one developing unit of the magnetic brush type is disclosed opposite to an electrostatic latent image carrier, said developing unit having a developing sleeve in which is housed a magnetic roller having a weak-magnetic or non-magnetic portion. The developing unit also has drive means for rotating the magnetic roller and the developing sleeve a specified degree, whereby the magnetic roller is so rotated that its weak-magnetic or non-magnetic portion is allowed to pass a position opposite to a level regulating member, and whereby the developing sleeve is subsequently so rotated until its outer peripheral portion opposite to the weak-magnetic or non-magnetic portion reaches a position opposite to the electrostatic latent image carrier. Thus, a developing powder present on the outer periphery of the developing sleeve is shunted away from a developing zone on the outer periphery. Such shunting of the developing powder is carried out with any of the developing unit other than one selected for developing operation.

6 Claims, 4 Drawing Sheets

1
2
3
4
5
6
7
8
9
10
41
42
43
44a
44b
45
46
49
51
52
53
54a
54b
55
56
59
90
X1
X2
a
b
b1
c
d
e
S1
N1
S2
N2

MAGNETIC BRUSH TYPE DEVELOPING APPARATUS FOR DEVELOPMENT OF ELECTROSTATIC LATENT IMAGE

BACKGROUND OF THE INVENTION

1. Field of the Invention

The present invention relates to a magnetic brush type developing apparatus for use in developing electrostatic latent images with a toner into visible images.

2. Description of the Prior Art

Generally, a developing apparatus of such magnetic brush type has a magnetic roller disposed in a developing sleeve, the magnetic roller having S-poles and N-poles circumferentially arranged thereon, so that a developing powder is transported on and along the developing sleeve to a developing zone opposite to the surface of an electrostatic latent image carrier in conjunction with the rotation of the developing sleeve and/or the magnetic roller.

One typical recent development in the field of electro-photocopying machines, reader printers, and the like is a developed image producing apparatus of such arrangement that a plurality of developing units are disposed around the surface of an electrostatic image carrier, one of the developing units being loaded with a developing powder including a black toner, the other developing unit being loaded with a developing powder including single-color toners, such as red, yellow, blue, or the like. In another arrangement, one of the developing unit is used for normal development (in which a positive original is for positive development) and the other is used for reversal development (in which a negative original is for reversal development), so that the developing units are selectively switched over from one to the other for development.

However, such apparatus has a limitation that while one of the developing units, so selected for development, is in developing operation, the other developing unit must be so adjusted that the developing powder on the outer periphery of its developing sleeve is kept in non-contact with the surface of the electrostatic latent image carrier in order to prevent the possibility of unnecessary toner deposition and also such possibility that a toner image formed by one developing unit located on the upstream side of the path of movement of the electrostatic latent image carrier surface may be disturbed by the developing powder on the other developing unit which is located on the downstream side of said path of movement.

Therefore, it has been proposed that one of such units which is not selected for development is displaced so that the outer periphery of its developing sleeve is kept away from the developing zone. However, this poses a problem that the arrangement necessarily involves drive means of a larger size for displacing either one of the developing units in its entirety and a larger size supporting mechanism; further, there must be good control of development gaps.

Another proposal is found in U.S. Pat. No. 3,572,288, issued Mar. 23, 1971 to Turner, such that a magnet is rotatably disposed in a separator plate so that when a developing unit is not in developing operation, the magnet is rotated away from a position at which it is opposed to an electrostatic latent image carrier, in order to displace the developing powder from a developing zone. However, such arrangement has a difficulty that since the developing powder is released from a magnetic force of restraint in the developing zone, some part of the developing powder mass falls off the developing unit unless said unit is positioned right under the surface of the electrostatic latent image carrier, which fact necessitates the provision of sufficient preventive measures against fall-off if the developing unit is disposed sidewise.

Similar measures are proposed in Japanese Published Unexamined Pat. Appl. No. 2057/1984, wherein when a developing unit is not in developing operation, a between-poles portion of a magnetic roller is positioned opposite to the surface of an electrostatic latent image carrier. Presumably, this idea may be based on the fact that a magnetic brush of a developing powder tends to rise at magnetic poles, whereas it tends to lie down at a location between poles. Indeed, such arrangement would be effective if employed with a developing powder using a ferrite carrier, in which case a magnetic brush is high enough when the developing powder is at poles, so that there is a substantial difference in brush height between a polar location and a between-poles location. However, where a developing powder using a small-diameter magnetic carrier is employed, the height of such brush is as low as a fraction of that in the former case, there being no much difference in height between a polar location and a between-poles location; therefore, no satisfactory effect can be expected.

SUMMARY OF THE INVENTION

The object of the present invention is to provide a developing apparatus which eliminates aforesaid difficulties with the prior art and can accurately dislocate developing powder masses from a developing zone, and which prevents unnecessary toner deposition and toner image disturbances due to the developing powder present on a developing unit unselected for developing operation.

In order to accomplish the above mentioned object, the developing apparatus in accordance with the present invention comprises a developing sleeve disposed opposite to an electrostatic latent image carrier, a magnetic roller for magnetically holding a developing powder on the outer periphery of the developing sleeve, said roller being disposed in said developing sleeve and having a weak-magnetic or non-magnetic portion, a level regulating member disposed opposite to the outer periphery of said developing sleeve for regulating the quantity of a developing powder to be transported on and along the outer periphery of said developing sleeve, first drive means for rotating said magnetic roller a specified degree so as to permit said weak-magnetic or non-magnetic portion of said magnetic roller to pass a position opposite to said level regulating member, and second drive means for rotating said developing sleeve a specified degree after the termination of the rotational movement of the magnetic roller by said first drive means and until the outer circumferential surface of the developing sleeve reaches a position opposite to the electrostatic latent image carrier from the position facing with said weak-magnetic or non-magnetic portion.

According to this arrangement, when the magnetic roller is rotated a specified degree by the first drive means, the developing powder on the outer periphery of the developing sleeve at a portion thereof corresponding to the weak-magnetic or non-magnetic portion is scraped off by the level regulating member, so that an area in which no developing powder is present is formed on the outer periphery of the developing sleeve at said portion corresponding to the weak-magnetic or non-magnetic portion. Subsequently, the developing sleeve is rotated a specified degree by the second drive means, whereupon the portion on which no developing powder is present is positioned opposite to the surface of the electrostatic latent image carrier. The developing powder has now been removed from the developing zone. Thus, the developing powder on any one developing unit which is not in developing operation is prevented from being brought into contact with the surface of the electrostatic latent image carrier.

According to the present invention having such arrangement and function, it is possible to provide a developing apparatus which is much more compact than any conventional one of the type in which each developing unit is moved or dislocated. As compared with such prior art arrangement that when not in developing operation, a magnetic roller is rotated so that its non-magnetic portion is positioned opposite to the surface of an electrostatic latent image carrier, the present invention has a definite advantage in that even if each developing unit is disposed sidewardly of such carrier surface, there is no possible loss of developing powder out of the unit, no special means being required for prevention of such loss. Further, as compared with such conventional type that when not in developing operation, the magnetic roller is rotated to cause a between-poles portion thereof to be positioned opposite to the surface of the electrostatic latent image carrier, the arrangement according to the present invention can be more advantageously employed, even where the developing powder is of the type which provides no much difference in magnetic brush height between a polar location and an intermediate location between poles.

BRIEF DESCRIPTION OF THE DRAWINGS

These and other objects and features of the present invention will become apparent from the following description taken in conjunction with the preferred embodiments thereof with reference to the accompanying drawings, in which.

DETAILED DESCRIPTION OF THE INVENTION

Figure 1:
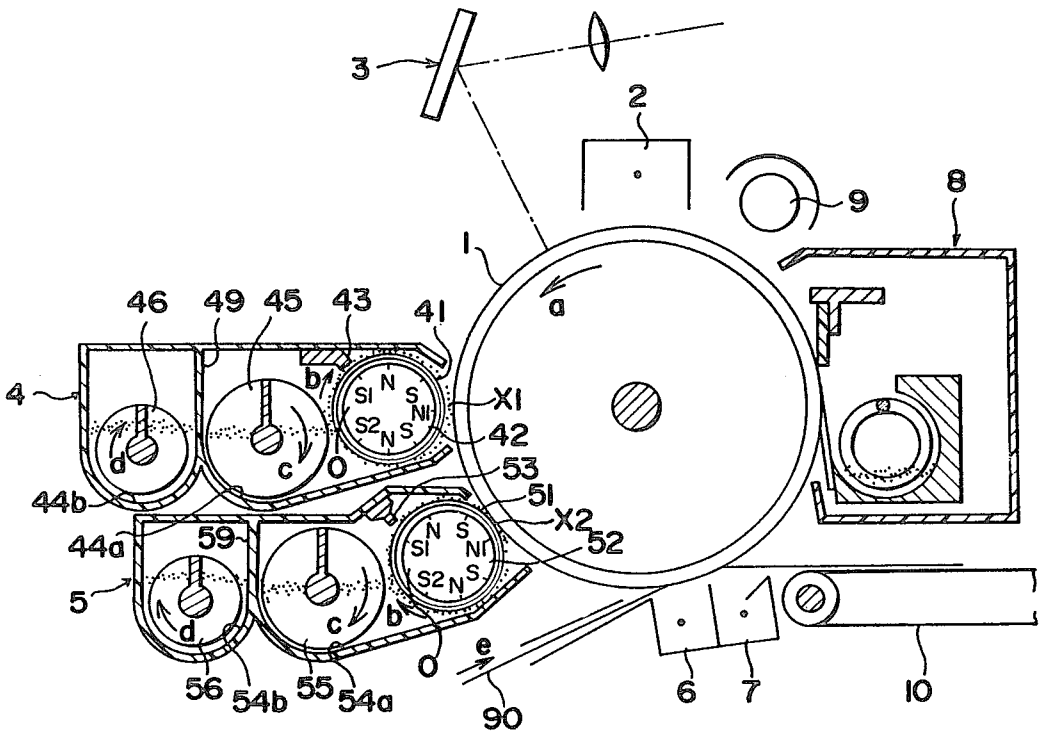
FIG. 1 is a schematic block diagram showing an electrophotocopying machine.

FIG. 1 shows a schematic arrangement of an electrophotocopying machine. A photosensitive drum 1 having an electrostatic latent image carrier layer laid on its outer periphery is rotatable in the direction of arrow a. Around the drum 1 there are disposed a corona charger 2, an exposure unit 3 of the slit exposure type, two developing units, namely, a first developing unit 4 and a second developing unit 5, circumferentially arranged in serial relation to each other, a transfer charger 6, a copying sheet separation charger 7, a residual toner cleaning unit 8 of the blade type, and a residual charge eraser lamp 9.

As is well known, a copying operation is carried out in the following sequence. A certain amount of electric charge is first applied by the corona charger 2 on the surface of the photosensitive drum 1 which is in rotation in the direction of arrow a, and an electrostatic latent image is produced on the drum surface by light irradiation from the exposure unit 3. Then, the first developing unit 4 or the second developing unit 5, whichever may be preselected, is selectively operated, and a toner is supplied to the electrostatic latent image in a developing zone X1 or X2, so that the latent image is developed into a visible image.

The toner image thus formed is transported to a portion opposite to the transfer charger 6 as the photosensitive drum 1 is rotated, so that it is transferred onto a sheet 90 delivered in the direction of arrow e.

The sheet 90 onto which the toner image is transferred is transported on a conveyor belt 10 to a fixing unit not shown, in which the toner image is fixed to the sheet 90, which is then discharged.

The photosensitive drum 1 which has passed through the transfer zone is subjected to scraping of any residual toner by the cleaning unit 8, being then subjected to light irradiation by the eraser lamp 9 for residual charge erasing. The drum 1 is now ready for a next cycle of copying.

Nextly, the first and second developing units 4, 5 will be explained. It is to be noted that the first developing unit 4 and the second developing unit 5 are of same arrangement except that different developing powder is used. For convenience sake, therefore, explanation will be given solely with respect to the first developing unit 4, which explanation is equally applicable to the second developing unit 5.

The first developing unit 4 is of the magnetic brush type and uses a two-component developing powder which consists of insulating toner and carrier. This developing unit 4 has a developing sleeve 41 disposed opposite to the photosensitive drum 1, said sleeve 41 incorporating a magnetic roller 42 having N- and S-poles magnetized on the outer periphery thereof. On the outer periphery of the magnetic roller 42 there is formed a non-magnetized portion 0 between magnetic poles S1 and S2 and on the opposite side of a main magnetic pole N1. No magnetic force or a very weak magnetic force, if any, is present in the non-magnetized portion 0. This non-magnetized portion 0 is normally positioned opposite to a developing powder feeding position where a roller 45 is provided. The magnetic roller 42 is disposed in such a way that the main pole N1 is normally opposed to the developing zone X1 and the pole S1 is opposed to a level regulating plate 43.

The level regulating plate 43 is disposed in the developing unit 4 and opposite to the outer periphery of the developing sleeve 41 in spaced apart relation therewith in order to regulate the amount of the developing powder being transported on and along the outer periphery of the developing sleeve 41.

The developing powder is transported on the outer periphery of the developing sleeve 41 in the direction of arrow b while being attracted onto the outer periphery of the sleeve 41 by a magnetic force of the magnetic roller 42, as the sleeve 41 is rotated in the arrow b direction. The amount of developing power being transported is regulated by the level regulating plate 43 as the developing powder passes through the plate 43.

On the opposite side of the drum 1 there is formed developing powder circulation passages **44*a* and 44*b* partitioned by a partition wall 49 and communicating at the both ends of each passages. A roller 45 is disposed in the passage 44a for rotation in the direction of arrow c while a roller 46 is disposed in a passage 44b for rotation in the direction of arrow d. The developing powder is circulated along the passages 44a and 44b in conjunction with the rotation of the rollers 45, 46**.

Toner, which is stored in a toner bottle not shown, is introduced on the upstream side of the passage 44b in FIG. 1 when a toner supply signal is issued. The toner so introduced is mixed with the developing powder and the mixture is transported along the passage 44b in the arrow d direction while being further mixed and agitated as the roller 46 rotates, the mixture being triboelectrified in course of this transport. The developing powder is allowed to be introduced into the passage 44a as it is conveyed inward along the passage 44b as viewed in the drawings, and is transported further outward by the roller 45 until it is delivered onto the outer periphery of the developing sleeve 41.

The developing powder on the developing sleeve 41 is transported on and along the outer periphery of the sleeve 41 in the arrow b direction (for developing service) as the sleeve 41 rotates, and subsequently it is released from magnetic force via the non-magnetized portion 10. The developing powder is thus evacuated from the outer periphery of the developing sleeve 41.

The developing powder to be used in the first developing unit 4 is the mixture of small-diameter magnetic carrier and non-magnetic insulating color toner, whereas the developing powder to be used in the second developing unit 5 is the mixture of small-diameter magnetic carrier and conventional non-magnetic, insulating black toner.

The first and second developing units 4, 5 are selectively used for each copying operation by the operator manipulating a selector switch provided on a control panel not shown.

Therefore, whichever developing unit 4 or 5 may be non-selected, it is necessary that the developing powder on the corresponding developing sleeve 41 or 51 should be removed from the relevant developing zone X1 or X2 in order to prevent it from being brought into contact with the surface of the photosensitive drum 1.

Figure 2:
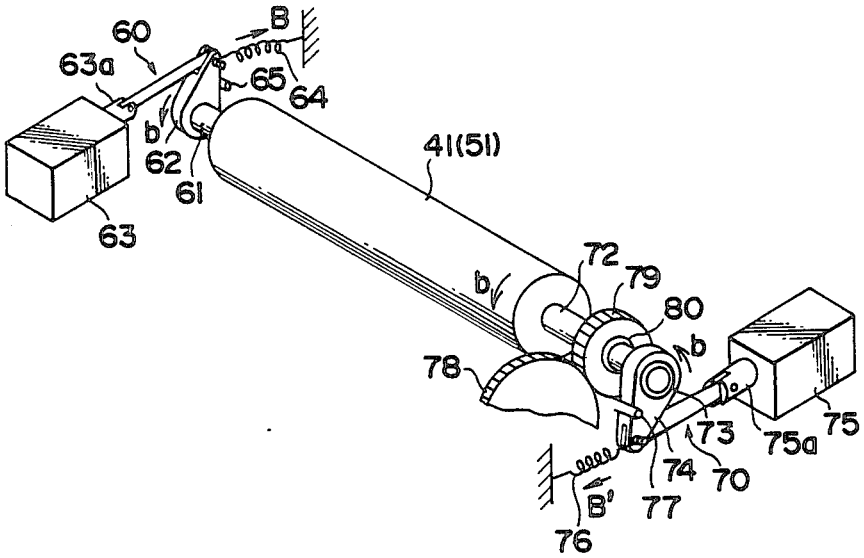
FIG. 2 is a perspective view showing drive means.
Figure 3:
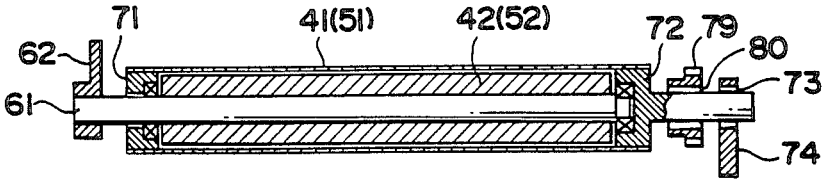
FIG. 3 is a sectional view showing a developing sleeve portion.

So, for the purpose of removing the developing powder from the developing zones X1, X2, there are provided drive means 60, 70 shown in FIGS. 2 and 3 respectively.

The drive means 60 has a function to rotate the magnetic roller 42 a specified degree. A plunger 63a for a solenoid 63 is connected to an arm 62 which is fixed to a support shaft 61 of the magnetic roller 42. The arm 62 is biased by a coil spring 64 in the direction of arrow B and is positionally regulated by a stopper pin 65. The support shaft 61 is rotatable relative to an end collar 71 of the developing sleeve 41 and a shaft member 72. Therefore, the plunger 63a is retracted when the solenoid 63 is turned on, and accordingly the magnetic roller 42 is rotated a specified degree (90°) in the arrow b direction in conjunction with the arm 62.

Another drive means 70 has a function to rotate the developing sleeve 41 a specified degree. A plunger 75a for a solenoid 75 is connected to an arm 74 mounted to one end of a shaft member 72 through an one-way clutch 73. The arm 74 is biased by a coil spring 76 in the direction of arrow B′ and is positionally regulated by a stopper pin 77. Therefore, the plunger 75a is retracted when the solenoid 75 is turned on, and accordingly the developing sleeve 41 is rotated a specified degree (90°) in the arrow b direction in conjunction with the arm 74.

During developing operating, the developing sleeve 41 is driven by a drive power source not shown to rotate in the arrow b direction through gears 78 and 79. This rotation is in no way transmitted to the arm 74 by idle run of the one-way clutch 73. Similarly, the rotation of the developing sleeve 41 in the arrow b direction through turning on of the solenoid 75 is in no way transmitted to the rotation drive system by idle run of an one-way clutch 80 provided on the gear 79.

Figure 4:
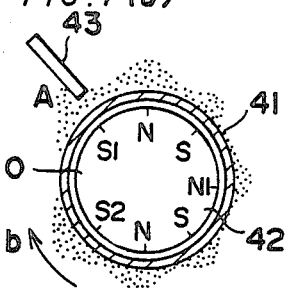
FIGS. 4*a*–4*d* are explanatory views showing developing powder masses in movement on the outer periphery of the developing sleeve.
Figure 4:
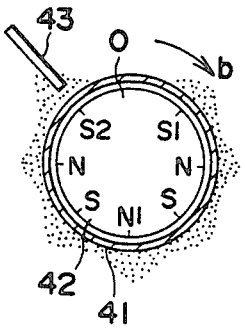
Figure 4:
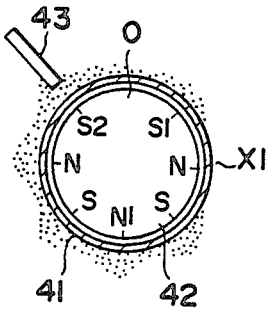
Figure 4:
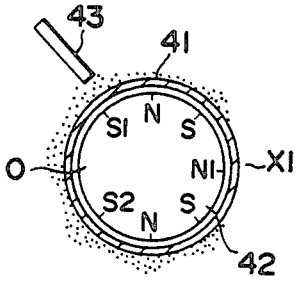

Now, the movement of the developing powder on the outer periphery of the developing sleeve 41 will be explained with reference to FIG. 4.

As FIG. 4a shows, the magnetic roller 42 is normally set in such way that the magnetic pole S1 thereon is positioned opposite to the level regulating plate 43, and the developing powder is supplied onto portion A by the roller 45, being transported in the arrow b direction as the developing sleeve 41 is rotated in that direction. During this transport, a magnetic brush of the developing powder becomes thin and tends to rise up at magnetic pole locations, while it becomes dense and tends to lie down on the between-poles locations. The developing powder is released from a magnetic force of restraint when it is on the non-magnetized portion 0.

At any non-developing stage during which the sleeve 41 is not in rotation, if the solenoid 63 is turned on to actuate the magnetic roller 42 to rotate in the arrow b direction, the developing powder on the non-magnetized portion 0 is scraped off by the level regulating plate 43 as said portion 0 passes the plate 43. The developing powder so scraped off is attracted onto the pole S2. Thus, a portion on which no developing powder is present is formed on the outer periphery portion of the developing sleeve 41 which corresponds to the non-magnetized portion 0 (see FIG. 4b).

Then, the solenoid 75 is turned on to actuate the developing sleeve 41 to rotate 90° in the arrow b direction, and the developing powder is moved along with the developing sleeve 41, so that the portion on which no developing powder is present is positioned in the developing zone X1 opposite to the surface of the photosensitive drum 1 (see FIG. 4c). Thus, the developing powder has been eliminated from the developing zone X1.

At this point of time, the solenoids 63, 75 are turned off. Then, the magnetic roller 42 only rotates 90° in the direction opposite to the arrow b to return. The developing sleeve 41 does not return, but the arm 74 only is caused to reset by idle run of the one-way clutch 73. The developing powder remains unmoved, so that the portion on which no developing powder is present is positioned in the developing zone X1 as it is (see FIG. 4d).

Description has now been made exclusively with the first developing unit 4 by way of example. It must be noted that same description equally applies to the second developing unit 5.

Figure 5:
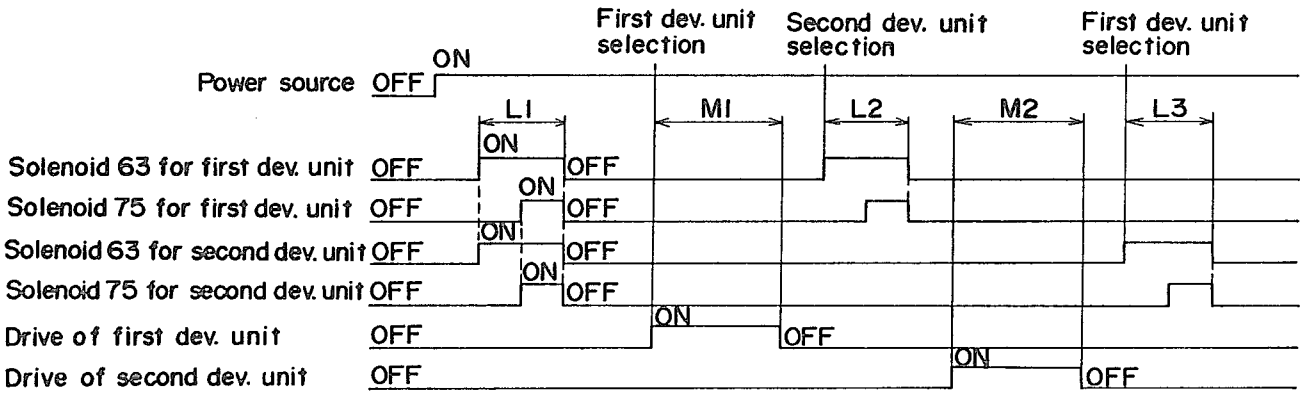
FIG. 5 is a time chart.

A series of operations involved with respect to the present embodiment will be explained on the basis of the time chart in FIG. 5.

When the power source for the copying machine is turned on, developing powder is excluded from the developing zones X1, X2 in zone L1. At this stage, the solenoids 63, 75 for both the first and second developing units 4, 5 are turned on one after the other, and are turned off simultaneously so that the condition as shown in FIG. 4d is reached. Now, if the first developing unit 4, for example, is selected for operation, the unit 4 is actuated to carry out copying operation at zone M1. If the second developing unit 5 is selected after the above operation, the actuation of the first developing unit 4 is turned off, and then the solenoids 63, 75 for the first developing unit 4 are turned on and off at zone L2. After developing powder has been excluded from the developing zone X1 of the first developing unit 4, the second developing unit 5 is actuated at zone M2 for copying operation. The developing powder is excluded from the developing zone X2 of the second developing unit 5 at zone L3, that is, only when the first developing unit 4 is selected for next operation.

Developing experiments were carried out by employing the above described developing apparatus and under the following conditions: development gap, 0.55 mm; brush height regulation gap, 0.45 mm; magnetic roller outer diameter, 24.5 mm; developing sleeve rotation speed, 173 rpm; and photosensitive drum peripheral speed, 111 mm/sec. Developing powder was accurately excluded from the developing zones X1, X2 through on/off movement of the solenoids 63, 75. There was no outward spillage of developing powder, and satisfactory copy images were obtained. In the present embodiment, when the magnetic rollers 42, 52 are rotated 90°, the non-magnetized portion is positioned on the top side, and therefore there is no possibility of developing powder spillage when the magnetic rollers 42, 52 are rotated.

The developing apparatus according to the invention is not limited to the above described embodiment and may be modified, altered, or changed within the spirit and scope of the invention.

For the above described drive means 60, 70 in particular, various forms of arrangement other than the above described combination of solenoids 63, 75 and arms 62, 74 may be adopted. Further, the timing for exclusion of developing powder from the developing zones X1, X2 is not limited to that shown in the time chart. It is also to be understood that the angle of rotation of the magnetic rollers 42, 52 and of the developing sleeves 41, 51 by the solenoids 63, 75 is not limited to that in the above described embodiment. Generally, it may be said that the smaller the angle of rotation, the less disturbance is likely to occur on the developing sleeves 41, 51, with better results.

In case where a sealing member is provided on the top of the second developing unit 5 for contact with the surface of the photosensitive drum 1 in order to seal any toner dust which may rise from the developing zone X2, it is necessary that the sealing member should be separated from the surface of the drum 1 so as to allow toner images to transfer when the first developing unit 4 is selected for operation. Movement of such seal member may be associated with the drive means 60, 70. The number of developing units is not limited to two, but alternatively it may be three. Further, if the present invention is applied to only one developing units, it is possible to prevent any deterioration of the photosensitive material and photosensitive drum that may result from the contacting of the developing powder with the surface of the drum during a stand-by period or any fall-off of developing powder during photosensitive drum replacement.

What is claimed is:

1. A developing apparatus comprising:

a developing sleeve disposed opposite to an electrostatic latent image carrier, a magnetic roller for magnetically holding a developing powder on the outer periphery of the developing sleeve, said roller being disposed in said developing sleeve and having a weak-magnetic or non-magnetic portion, a level regulating member disposed opposite to the outer periphery of said developing sleeve for regulating the quantity of a developing powder to be transported on and along the outer periphery of said developing sleeve, first drive means for rotating said magnetic roller a specified degree so as to permit said weak-magnetic or non-magnetic portion of said magnetic roller to pass a position opposite to said level regulating member, and second drive means for rotating said developing sleeve a specified degree after the termination of the rotational movement of the magnetic roller by said first drive means and until the outer circumferential surface of the developing sleeve reaches a position opposite to the electrostatic latent image carrier from the position facing with said weak-magnetic or non-magnetic portion.

2. A developing apparatus as set forth in claim 1 further including a third drive means for continuously rotating the developing sleeve in one direction for developing an image formed on said carrier.

3. A developing apparatus as set forth in claim 2 wherein the first drive means is for moving said magnetic roller in the direction of rotation of said developing sleeve driven by said third drive means, said rotation being the direction from the upstream side of said level regulating member toward the downstream side thereof.

4. A developing apparatus comprising:

a developing sleeve disposed opposite to an electrostatic latent image carrier, means for feeding a developing powder onto the outer periphery of said developing sleeve, a magnetic roller for magnetically holding the developing powder on the outer periphery of the developing sleeve, said roller being disposed in said developing sleeve and having a weak-magnetic or non-magnetic portion at a location opposite to or adjacent to a developing powder feeding position, first drive means for continuously rotating said developing sleeve in one direction for transporting the developing powder present on the outer periphery of the developing sleeve to a developing zone opposite to the electrostatic latent image carrier so as to develop an image formed on said carrier, a level regulating member disposed opposite to the outer periphery of said developing sleeve and between said developing powder feeding position and said developing zone for regulating the quantity of the developing powder being transported on and along the outer periphery of said developing sleeve.

second drive means for rotating said magnetic roller, when rotation of the developing sleeve by said first drive means has been halted, so as to allow said weak-magnetic or non-magnetic portion of the magnetic roller to be positioned on the downstream side of said level regulating member in the direction of transport of the developing powder, and third drive means for rotating said developing sleeve after the termination of the rotational movement of the magnetic roller by said second drive means and until the outer circumferential surface of the developing sleeve reaches a position opposite to the electrostatic latent image carrier from the position facing with said weak-magnetic or non-magnetic portion.

5. A developed image producing apparatus comprising first and second developing units arranged in serial to each other around an electrostatic latent image carrier and in the direction of movement thereof, said first and second units each including:

a developing sleeve disposed opposite to an electrostatic latent image carrier, a magnetic roller disposed in said developing sleeve and having a weak-magnetic or non-magnetic portion, a level regulating member disposed opposite to the outer periphery of said developing sleeve for regulating the quantity of a developing powder to be transported on and along the outer periphery of said developing sleeve, drive means for rotating said magnetic roller a specified degree so as to permit said weak-magnetic or non-magnetic portion to pass a position opposite to said level regulating member, and drive means for rotating said developing sleeve a specified degree after the termination of the rotational movement of said magnetic roller by said first drive means and until the outer circumferential surface of the developing sleeve reaches a position opposite to the electrostatic latent image carrier from the position facing with said weak-magnetic or non-magnetic portion, said developed image producing apparatus further comprising:

drive means for continuously rotating said developing sleeve and/or magnetic roller in order to transport the developing powder unidirectionally on the developing sleeve for the purpose of development, means for selecting either the first or the second developing unit for developing operation, control means which, when one of said developing units is selected by said selecting means, causes the magnetic roller and developing sleeve of the other developing unit to be rotated a specified degree by their respective drive means in order to shunt the developing powder on the outer periphery of said developing sleeve away from a developing zone on said sleeve.

6. A developed image producing apparatus as set forth in claim 5, wherein said control means has a further function to cause the respective magnetic rollers and developing sleeves of said first and second developing units to be rotated a specified degree by their respective drive means, when a power source of the apparatus is turned on, in order to shunt the developing powder away from each of the developing zones on the respective outer peripheries of the developing sleeves.

* * * * *